US006536839B2

(12) United States Patent
Liu

(10) Patent No.: US 6,536,839 B2
(45) Date of Patent: Mar. 25, 2003

(54) FASTENING STRUCTURE FOR CHAIRS

(76) Inventor: Lausan Liu, No. 243, Chien Kwo Road, Hsin Tien City, Taipei Hsien (TW)

( * ) Notice: Subject to any disclaimer, the term of this patent is extended or adjusted under 35 U.S.C. 154(b) by 8 days.

(21) Appl. No.: 09/860,541

(22) Filed: May 21, 2001

(65) Prior Publication Data

US 2002/0171270 A1 Nov. 21, 2002

(51) Int. Cl.[7] ..... A47C 4/20
(52) U.S. Cl. ..... 297/39; 297/16.1
(58) Field of Search ..... 297/35, 39, 16.1

(56) References Cited

U.S. PATENT DOCUMENTS 4,536,026 A * 8/1985 Cornell ..... 297/39
5,054,848 A * 10/1991 Liu ..... 297/16.1
5,735,570 A * 4/1998 Tseng ..... 297/35
6,095,596 A * 8/2000 Chen ..... 297/35
6,206,462 B1 * 3/2001 Huang ..... 297/16.1

* cited by examiner

*Primary Examiner*—Peter R. Brown
(74) *Attorney, Agent, or Firm*—Rosenberg, Klein & Lee

(57) ABSTRACT

A fastening structure for chairs located between a rear foot and a back support of a leisure chair for preventing the leisure chair from unintentionally folding includes a latch sleeve slidably mounted on the rear foot and a fastener pivotally engaged with the rear foot and the back support. When the leisure chair is extended, the latch sleeve may be moved to engage with the fastener to prevent the fastener from moving away from the rear foot such that the rear foot and back support will maintain a latched and engaged relationship thereby to prevent the leisure chair from unintentional folding to ensure users safety.

2 Claims, 5 Drawing Sheets

FASTENING STRUCTURE FOR CHAIRS

BACKGROUND OF THE INVENTION (1) Field of the Invention

The invention relates to a fastening structure for chairs, and more particularly a fastening structure for preventing leisure chairs from unintentional folding.

(2) Description of the Prior Art

With the arriving of two-day weekend, people's life styles have gradually changed. After working intensely during the week days, taking some leisure trips or travelling on the weekend has become a main relaxation activity to many people. Goods to be used in the leisure activities have a growing demand. Leisure chair is one of the important and popular leisure goods. However the commonly used folding leisure chairs still have some shortcomings and potential risks. For instance, the general folding chairs mostly do not have safety means to prevent the chairs from incidental folding. An incidental folding of the chair could cause injury to people. Although some manufacturers have introduced folding leisure chairs with anti-folding means, they generally have complicated structure and are more expensive, therefore are not widely accepted in the market place. There are some simpler safety means which use a hook to latch one side of the chair for preventing the chair from unintentional folding. However they still will clip and hurt users' fingers accidentally. They are not desirable design. There are still rooms for improvement.

SUMMARY OF INVENTION

In view of the foregoing disadvantages, it is therefore an object of the present invention to provide a fastening structure for preventing a folding leisure chair from unintentional folding.

The foregoing, as well as additional objects, features and advantages of the present invention will be more readily apparent from the following detailed description, which proceeds with reference to the accompanying drawings.

DETAILED DESCRIPTION OF THE PREFERRED EMBODIMENT

Figure 1:
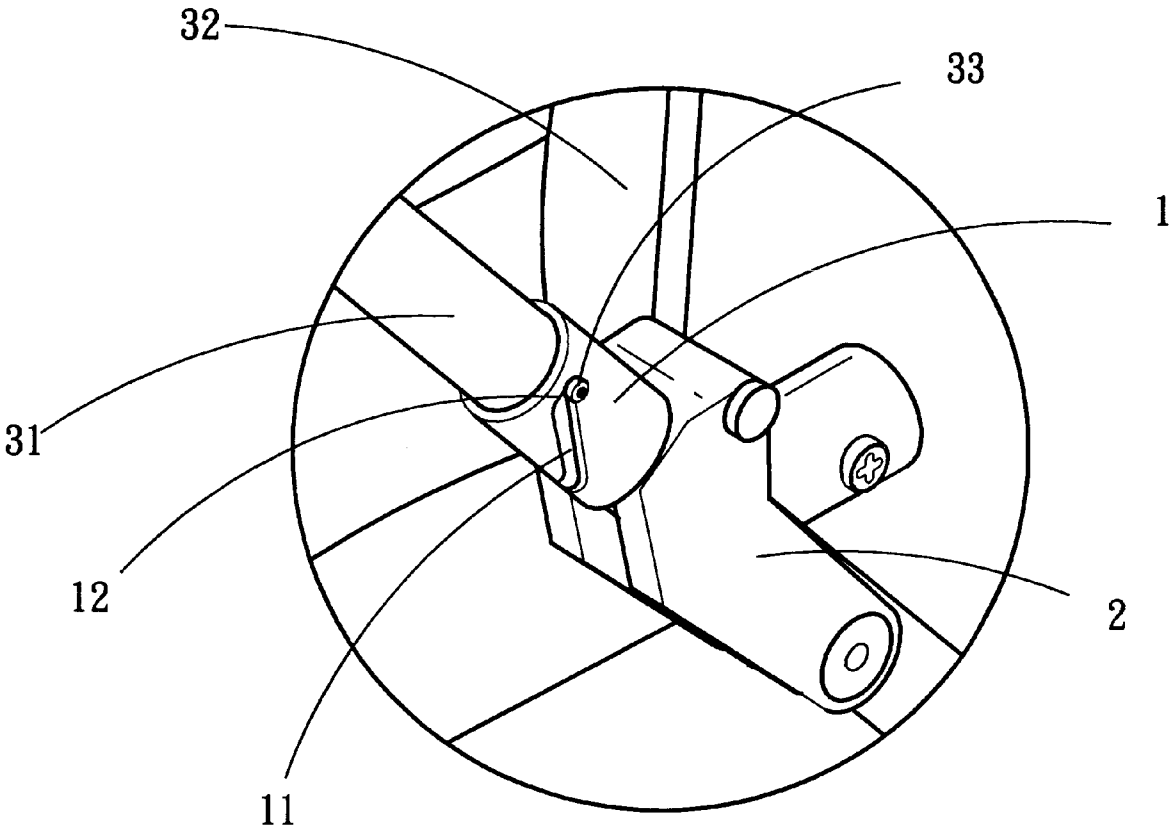
FIG. 1 is a perspective view of the present invention.
Figure 2:
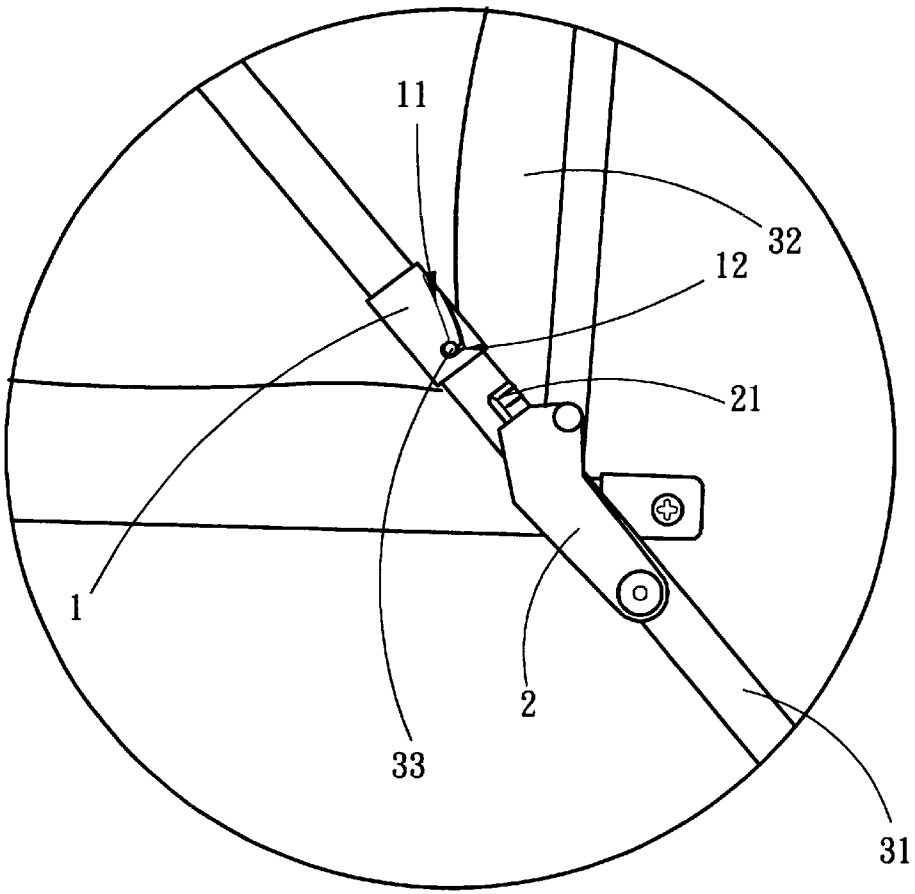
FIG. 2 is a side view of the present invention.

Referring to FIGS. 1 and 2, the fastening structure according to the present invention includes a latch sleeve 1 and a fastener 2 attached to a rear foot 31 and a back support 32 of a leisure chair 3. The latch sleeve 1 is slidably mounted on the rear foot 31 and has a slot 11 which have two ends each forms a retain notch 12 thereof. There is a strut 33 fixedly fastened to the rear foot 31 and housed in the slot 11.

The fastener 2 has a first end pivotally engaged with the rear foot 31 and a second end pivotally engaged with the back support 32. The fastener 2 at the second end further has a fasten flange 21 extended and mating against the latch sleeve 1.

Figure 3:
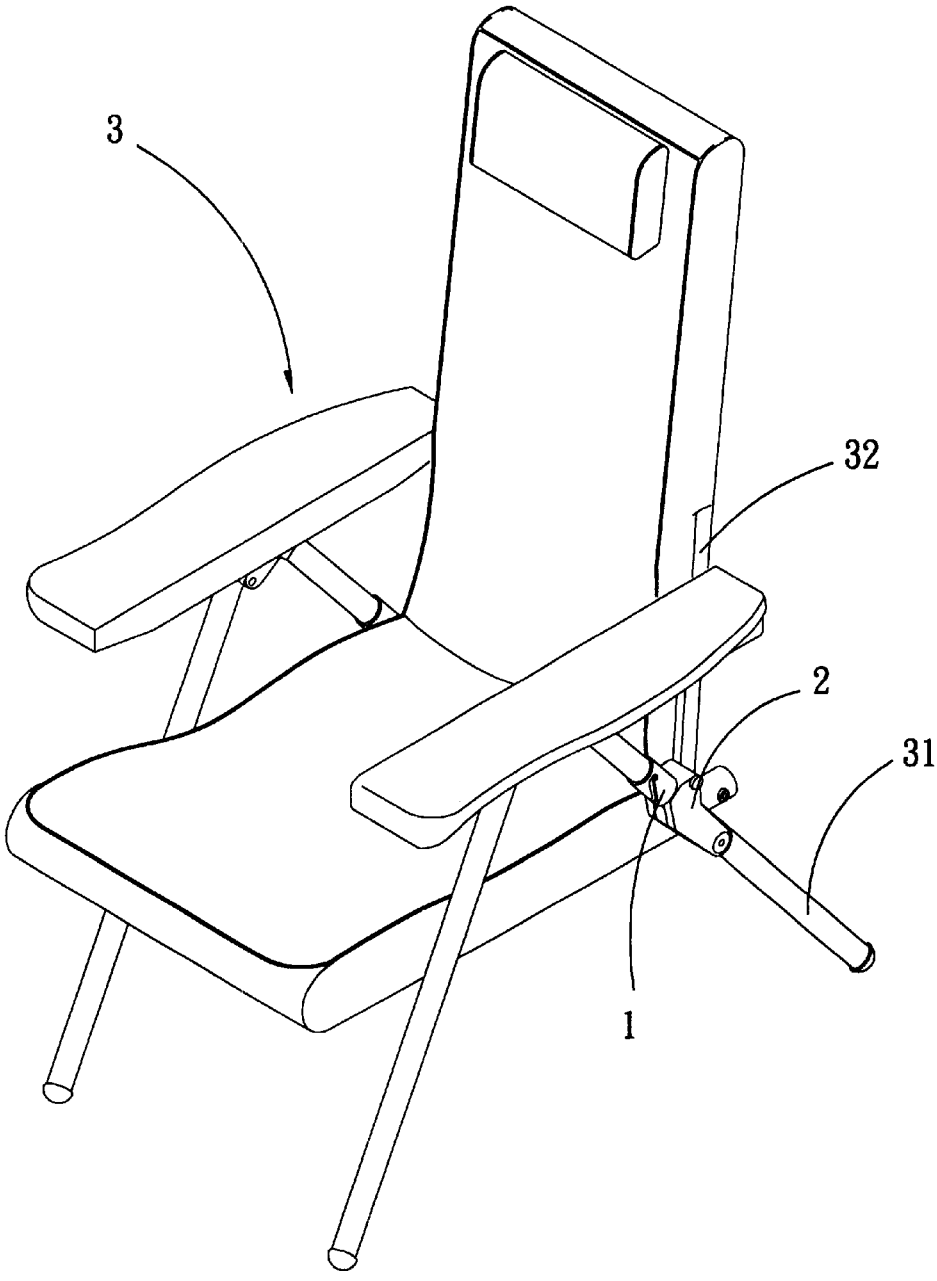
FIG. 3 is a schematic view of an embodiment of the present invention.
Figure 4A:
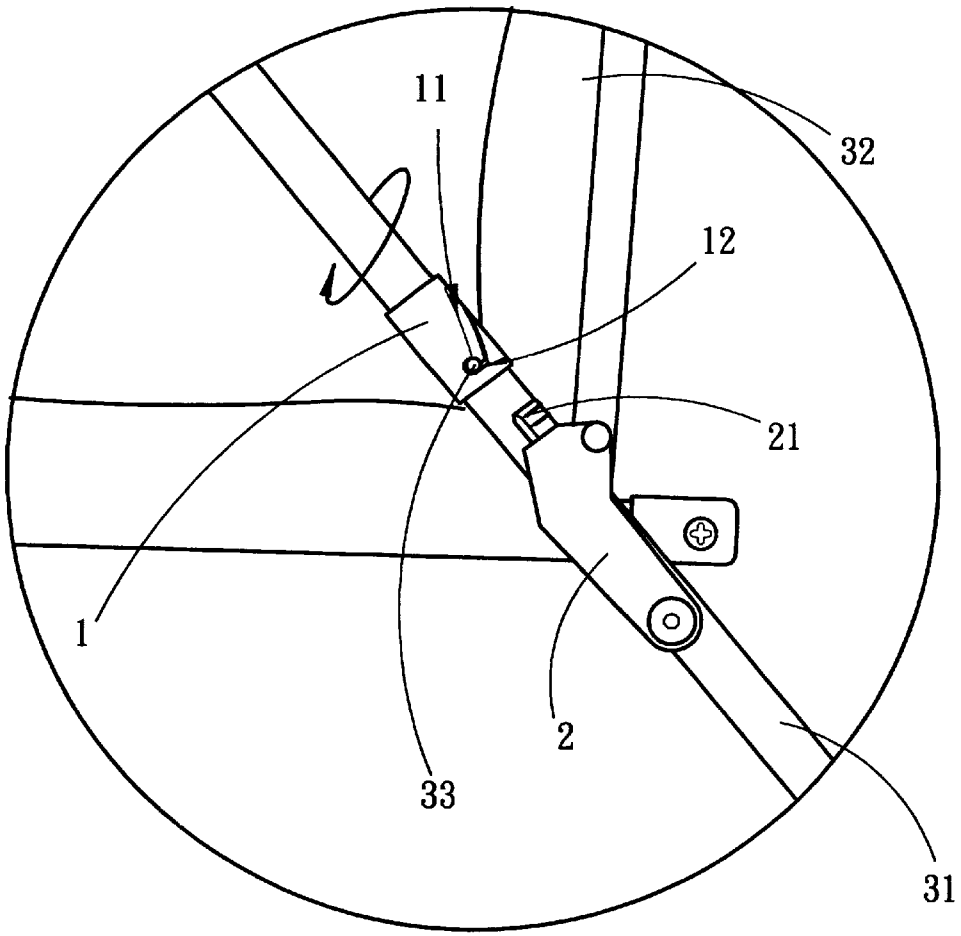
FIG. 4A is a schematic view of the present invention in use, under fastening.
Figure 4B:
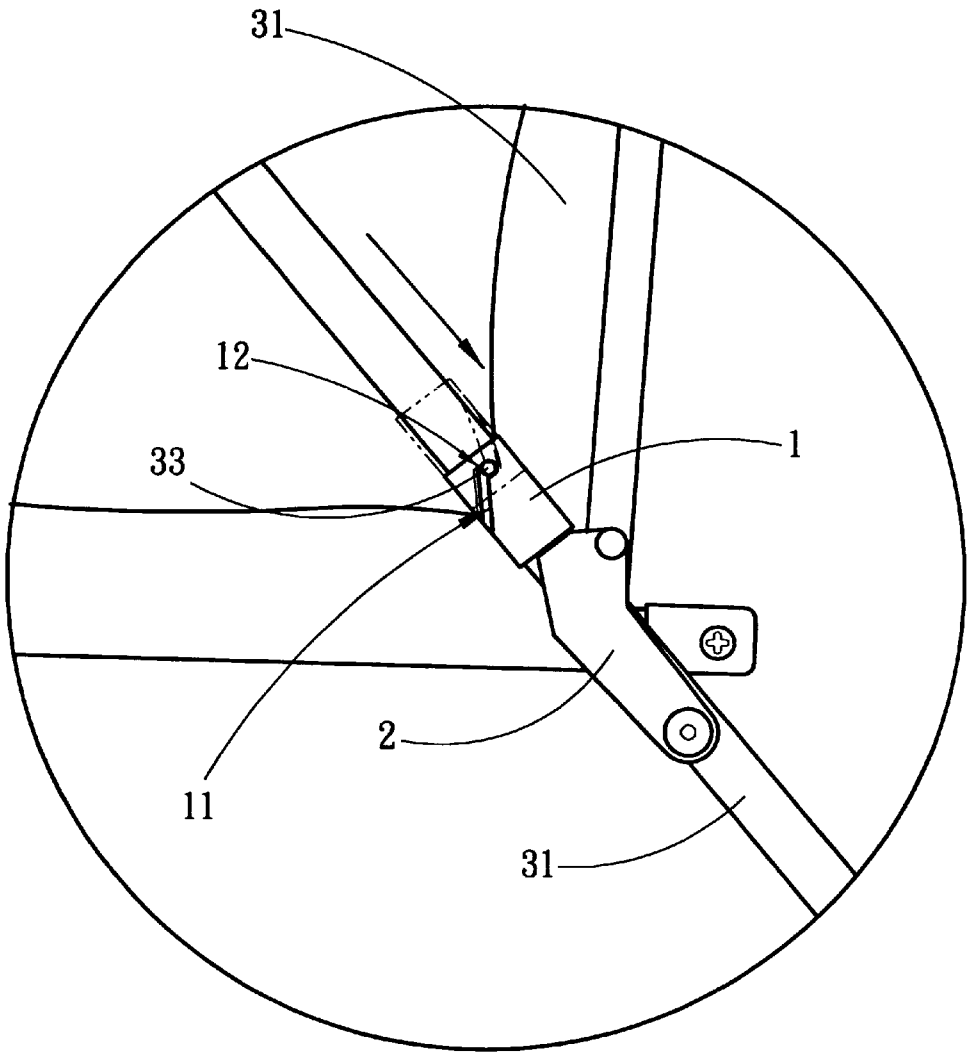
FIG. 4B is a schematic view of the present invention in use, being fastened.

Referring to FIGS. 3, 4A and 4B for an embodiment of the present invention which is disposed between the rear foot 31 and back support 32 of a leisure chair 3. When in use with the leisure chair 3 being extended, the fastener 2 is driven by the extending back support 32 and is pivotally turned to contact the rear foot 31. The fastening flange 21 faces the latch sleeve 1. Turn the latch sleeve 1 to make the slot 11 pressing against the strut 33 such that the latch sleeve 1 will slide downwards along the rear foot 11 until its lower end engaged with the fasten flange 21. Then the fastener 2 is not able to move away from the rear foot 31, and the strut 33 is engaged with the retain notch 12 of the slot 11. As a result, the rear foot 31 and back support 32 will be kept at a latched and engaged relationship, and the leisure chair will be prevented from unintentional folding and gives users better safety protection.

While the preferred embodiment of the present invention has been set forth for purpose of disclosure, modifications of the disclosed embodiment of this invention as well as other embodiments thereof may occur to those skilled in the art. Accordingly, the appended claims are intended to cover all embodiments which do not depart from the spirit and scope of the present invention.

I claim:

1. A fastening structure for chairs located between a rear foot and a back support of a leisure chair, comprising:

a latch sleeve slidably mounted on the rear foot, said latch sleeve having a slot formed therein, a pin being located in said slot and fixedly fastened to said rear foot, said slot having two ends, each end having a retain notch formed to receive said pins so that the relative relationship between the rear foot and the back support is secured; and, a fastener having a first end pivotally engaged with the rear foot and a second end pivotally engaged with the back support, wherein when the leisure chair is extended, the latch sleeve is moved to engage with the fastener to prevent the fastener from moving away from the rear foot, allowing the rear foot and the back support to maintain a latched and engaged relationship, restricting the leisure chair from unintentional folding and insuring the user's safety.

2. The fastening structure of claim 1, wherein the fastener has a fasten flange located at the second end mating against the latch sleeve.

* * * * *